US009227412B1

(12) United States Patent
Liu et al.

(10) Patent No.: US 9,227,412 B1
(45) Date of Patent: Jan. 5, 2016

(54) SCALABLE PRINTHEAD ARRAY MAINTENANCE

(71) Applicant: Xerox Corporation, Norwalk, CT (US)

(72) Inventors: Annie Liu, Webster, NY (US); David S. Derleth, Webster, NY (US); Matthew D. Savoy, Webster, NY (US); Frank B. Tamarez Gomez, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/708,509

(22) Filed: May 11, 2015

(51) Int. Cl.
*B41J 2/165* (2006.01)

(52) U.S. Cl.
CPC ..... *B41J 2/16547* (2013.01); *B41J 2/16544* (2013.01)

(58) Field of Classification Search
CPC ..... B41J 2/16547; B41J 2/16525; B41J 2/16552; B41J 2/16538; B41J 2/16544; B41J 2/16541
See application file for complete search history.

(56) References Cited

U.S. PATENT DOCUMENTS 5,548,310 A 8/1996 Binnert et al.
6,193,353 B1 2/2001 Vives et al.
6,343,850 B1 2/2002 Domagall
6,877,836 B2 4/2005 Wu
7,568,782 B2 * 8/2009 Kachi ..... B41J 2/16544 347/33
7,748,823 B2 7/2010 Hung
7,926,903 B2 * 4/2011 Yokoyama ..... B41J 2/16585 347/33
2011/0279536 A1 11/2011 Love et al.
2011/0279538 A1 11/2011 Love et al.
2014/0125749 A1 5/2014 Spence

* cited by examiner

*Primary Examiner* — Juanita D Jackson

(74) *Attorney, Agent, or Firm* — Maginot Moore & Beck LLP

(57) ABSTRACT

A maintenance system for maintaining a scalable printhead array comprises: a pair of tracks disposed in parallel and on opposite sides of a printhead array; a shaft extending between the tracks and configured to engage with each track to move along the tracks; a plurality of maintenance modules mounted in series along the shaft between the tracks and configured to move along the tracks with the shaft to perform maintenance operations on a plurality of printheads of the printhead array, the tracks being configured to guide the shaft and the plurality of maintenance modules along a path from a resting position to an operating position the printhead array and from which at least one of the plurality of maintenance modules performs a maintenance operation on at least one printhead of the printhead array; and an actuator configured to move the shaft along the tracks.

20 Claims, 17 Drawing Sheets

SCALABLE PRINTHEAD ARRAY MAINTENANCE

TECHNICAL FIELD

The system disclosed in this document relates to inkjet printers and, more particularly, to maintenance of scalable printhead arrays in such printers.

BACKGROUND

Inkjet printing is a process of producing an image on a substrate, such as a sheet of paper. Inkjet printing is an additive process in which one or more printheads eject drops of ink onto the substrate to form the image on the substrate. The printheads are operated with reference to digital image data that represents the image to be printed. Printing a multicolored image generally requires at least one printhead for each color. Additionally, printing high resolution images often requires multiple printheads of the same color that are interlaced to provide the increased resolution. Accordingly, many inkjet printing systems comprise arrays of several printheads arranged in rows and columns.

FIG. 20 shows a prior art architecture for a scalable printhead array 100. The printhead array 100 includes a plurality of printhead assemblies 104. The printhead array 100 is configured to include a variable number of printhead assemblies 104 arranged into rows and columns in a variety of possible arrangements. As shown, the printhead array 100 is scalable up to 50" in width and includes fourteen printhead assemblies 104. Each printhead assembly 104 is configured to receive a printhead 108 and to mount to frame 112 of the printhead array 100. FIG. 21 shows a more detailed view of one of the printhead assemblies 104 with a printhead 108.

To ensure optimal performance of an inkjet printhead, the printheads must be well-maintained. Typically maintenance operations include purging, capping, and wiping. Prior art mechanisms for printhead maintenance are not easily adapted for scalable printhead arrays. Being able to configure a printhead maintenance system so it is easily scalable for use with a scalable printhead array would be beneficial.

SUMMARY

A printhead maintenance system that is scalable with a scalable printhead array includes a pair of tracks disposed in parallel and on opposite sides of the printhead array; a shaft extending between the pair of tracks and configured to engage with each track of the pair of tracks and to move along the pair of tracks; a plurality of maintenance modules mounted in series along the shaft between the pair of tracks and configured to move along the pair of tracks with the shaft to perform maintenance operations on a plurality of printheads of the printhead array, the pair of tracks being configured to guide the shaft and the plurality of maintenance modules along a path from a resting position to an operating position the printhead array and from which at least one of the plurality of maintenance modules performs a maintenance operation on at least one printhead of the printhead array; and an actuator configured to move the shaft along the pair of tracks.

A maintenance cart for a printhead array includes a body configured to move selectively along a path to the printhead array; a pair of tracks being mounted in parallel on the body and configured to position the pair of tracks on opposite sides of the printhead array in response to the body moving to the printhead array; a shaft extending between the pair of tracks and configured to engage with each track of the pair of tracks and to move along the pair of tracks; a plurality of maintenance modules mounted in series along the shaft between the pair of tracks, the plurality of maintenance modules being configured to move along the pair of tracks with the shaft to perform maintenance operations on a plurality of printheads of the printhead array in response to the body being positioned at the printhead array, the pair of tracks being configured to guide the shaft and the plurality of maintenance modules along a path from a resting position to an operating position from which at least one of the plurality of maintenance modules performs a maintenance operation on at least one printhead of the printhead array; and an actuator configured to move the shaft along the pair of tracks.

BRIEF DESCRIPTION OF THE DRAWINGS

The foregoing aspects and other features of the maintenance system and maintenance cart for a printhead array are explained in the following description, taken in connection with the accompanying drawings.

DETAILED DESCRIPTION

Figure 1:
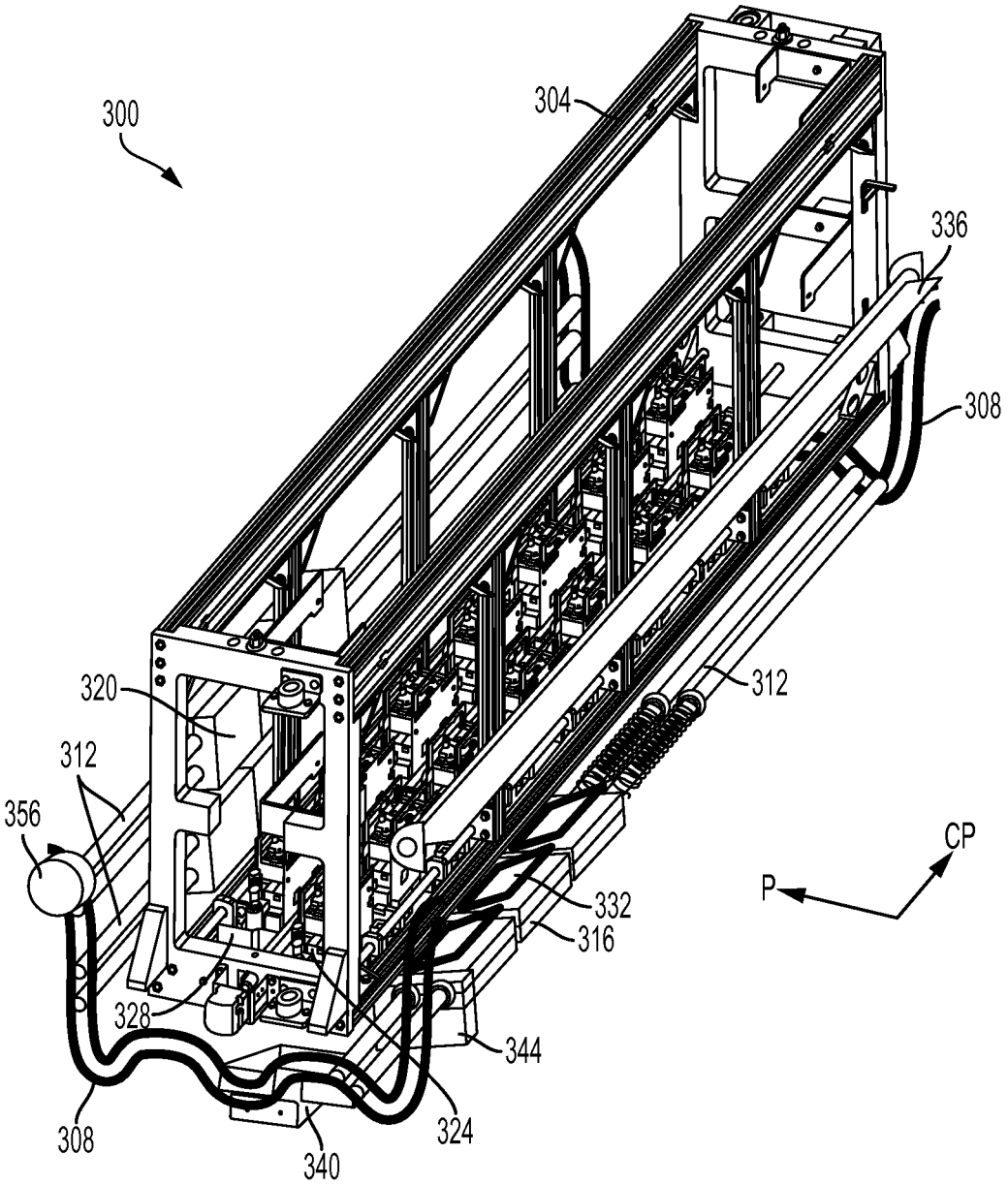
FIG. 1 shows a perspective view of a system for maintaining a scalable printhead array.

For a general understanding of the environment for the maintenance system and maintenance cart disclosed herein, as well as the details for the maintenance system and maintenance cart, reference is made to the drawings. In the drawings, like reference numerals designate like elements.

Figure 20:
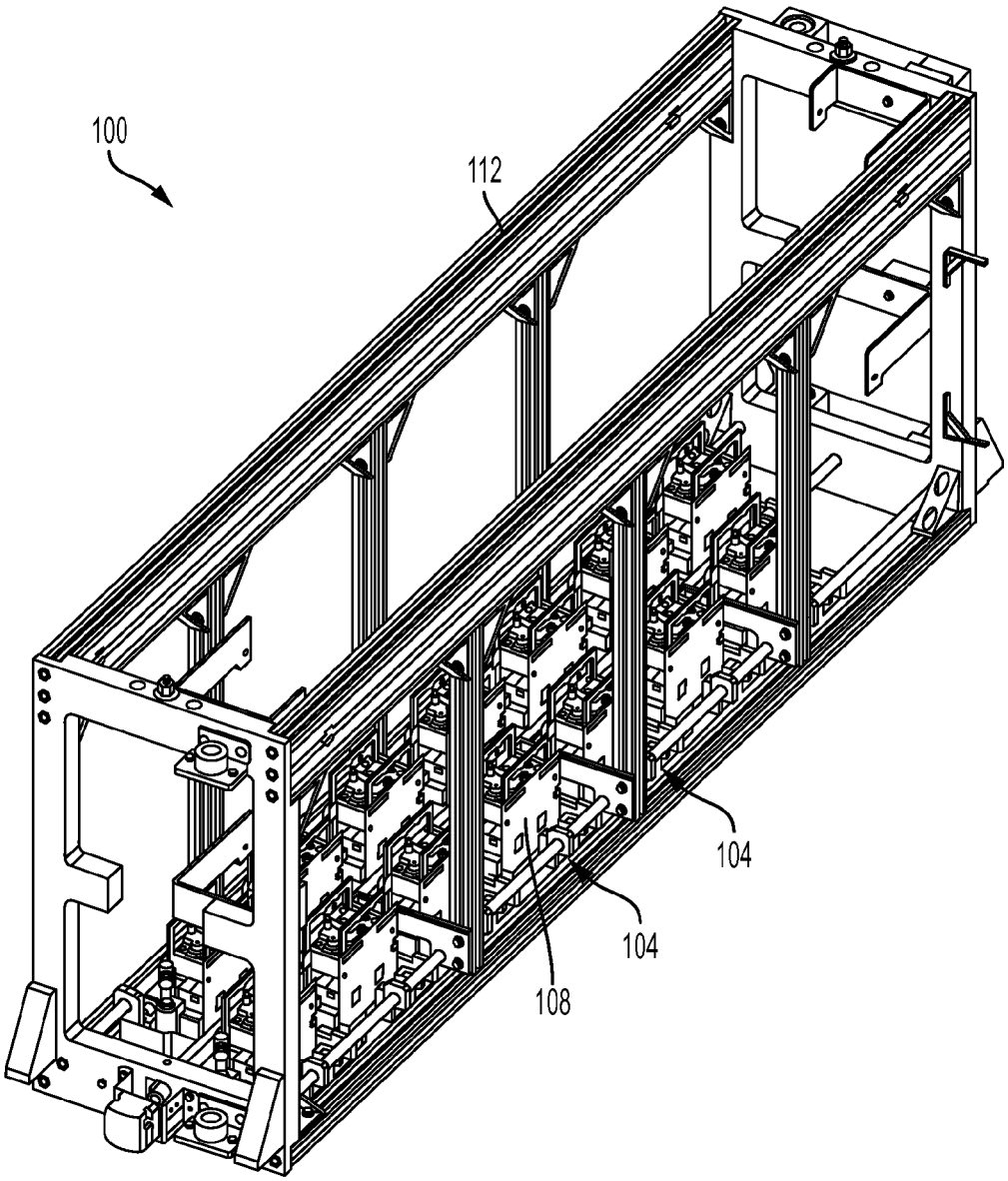
FIG. 20 PRIOR ART
FIG. 20 shows a prior art scalable printhead array.
Figure 21:
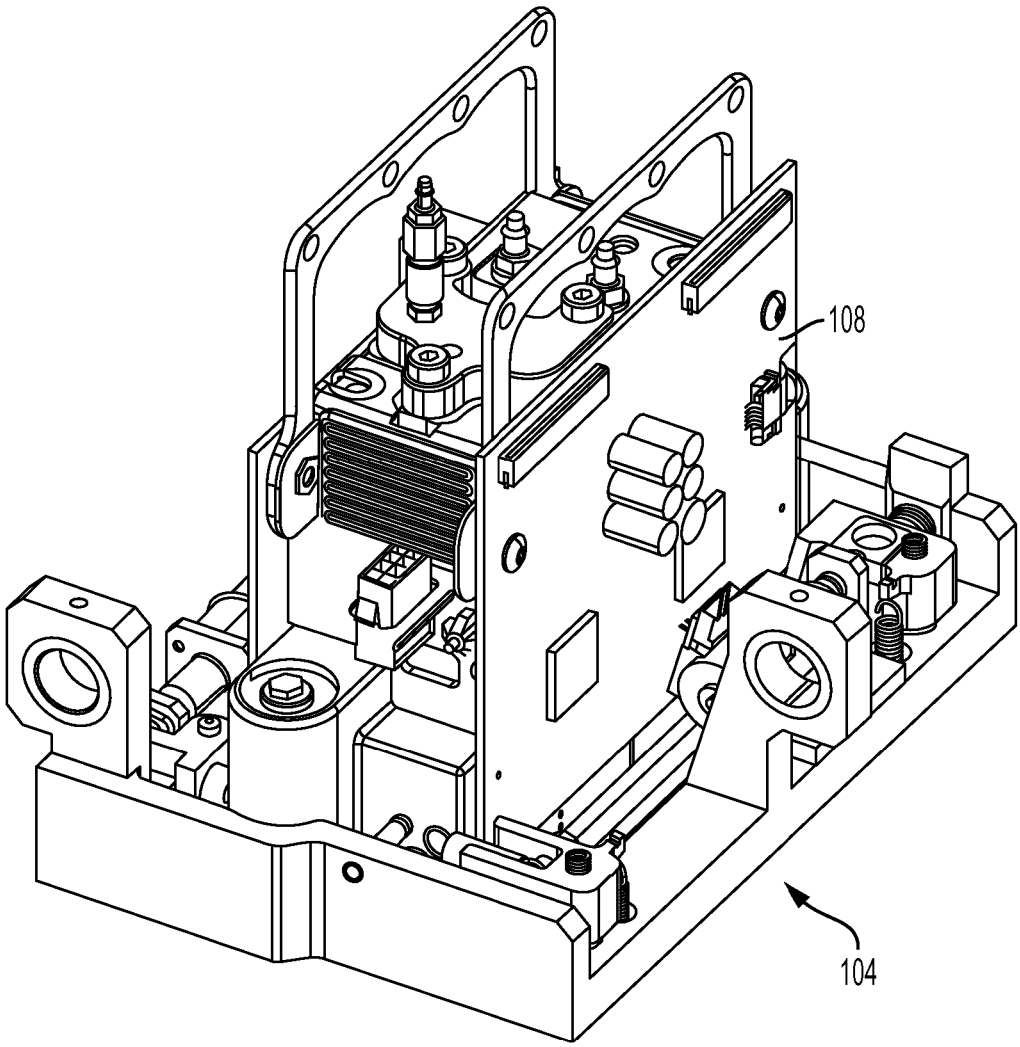
FIG. 21 PRIOR ART
FIG. 21 shows a prior art printhead assembly and printhead.

FIG. 1 shows one embodiment of a maintenance system 300 for maintaining a scalable printhead array according to the present disclosure. The system 300 is configured to perform maintenance operations on a scalable printhead array 304 having a variable number of printheads, similar to the printhead array 100 shown in FIG. 20. In one embodiment, the printhead array 304 has printheads arranged in two scalable rows. The maintenance system 300 is similarly scalable to match the arrangement of printheads on the printhead array 304. A pair of tracks 308 is arranged adjacent to the printhead array 304. Shafts 312 extend between the tracks 308 and are configured to engage with each of the tracks 308 to move along the tracks 308. A variable number of maintenance modules, including wiper modules 316 and capping modules 320 are mounted along the shafts 312 and configured to move along the tracks 308 with the shafts 312 to perform maintenance operations on the printheads of the printhead array 304.

The tracks 308 are arranged in parallel to one another and on opposite ends of the printhead array 304. In one embodiment, the tracks 308 run parallel to the process direction P of the printhead array 304 to enable the opposite ends of shafts 312 to move bi-directionally within the tracks 308. In one embodiment, the tracks 308 run down a first side of the printhead array 304, beneath the printhead array 304, and up a second side of printhead array 304, opposite the first side. In some embodiments, the tracks 308 are mounted to the printhead array 304. In other embodiments, the tracks 308 are mounted to a frame of a printer having the printhead array 304.

In some embodiments, the printhead array 304 includes a first row of printheads 324 and a second row of printheads 328. Maintenance modules 316, 320 are arranged along the shafts 312 to match the arrangement of printheads in at least one of the rows of printheads 324, 328. In some embodiments, the second row of printheads 328 has printheads arranged similarly to those of the first row of printheads 324. In these embodiments, the shafts 312 are configured with an arrangement of maintenance modules that aligns with the printheads of either of the rows of printheads 324, 328. In some embodiments, the second row of printheads 328 has printheads arranged similarly to those of the first row of printheads 324 but offset in the cross-process direction CP by a first distance. In one embodiment, the system 300 is configured to shift the maintenance modules 316, 320 in the cross-process direction CP by the first distance to enable the maintenance modules 316, 320 to perform maintenance operations on the second row of printheads 328.

Figure 2:
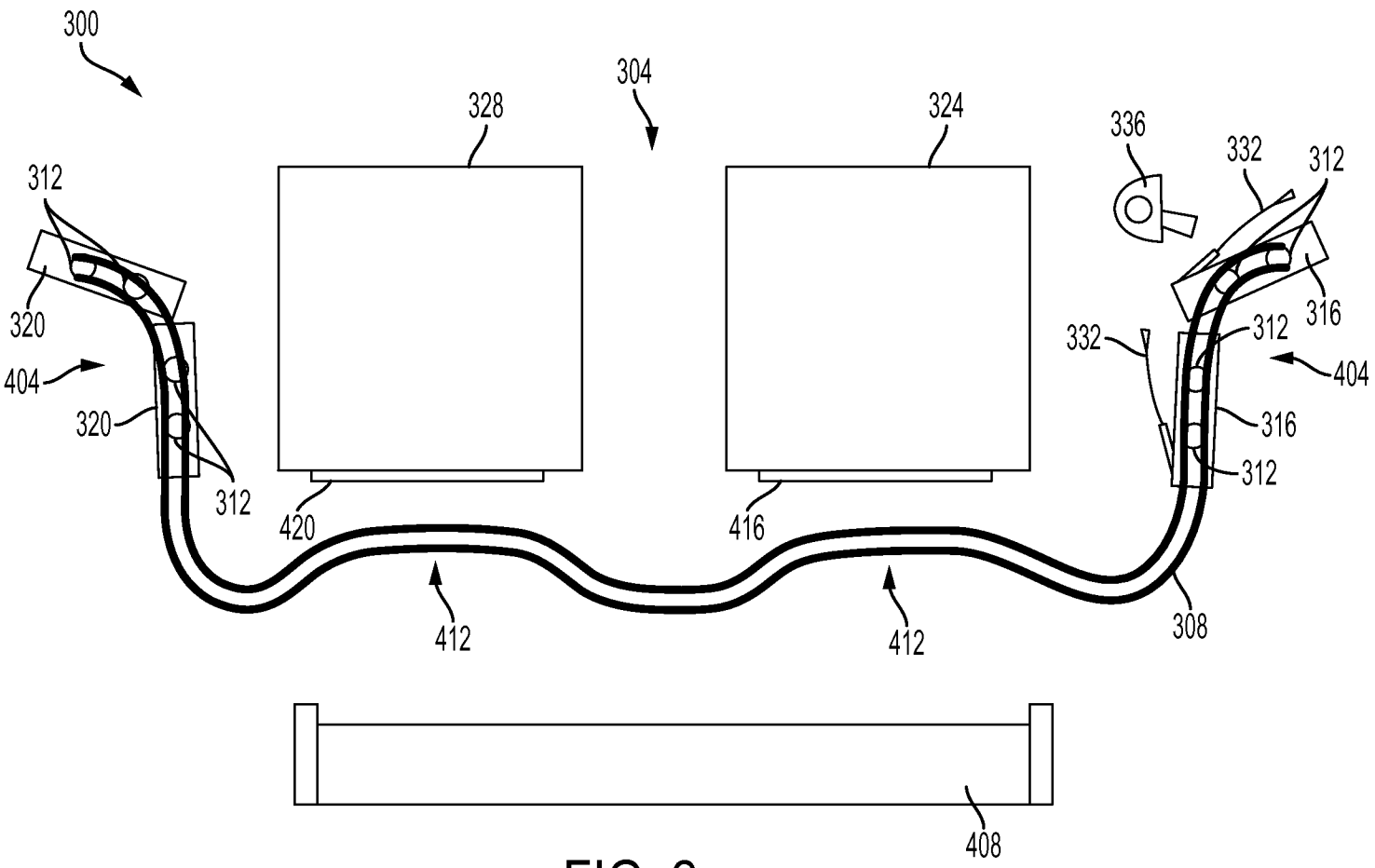
FIG. 2 shows a side view of the system of FIG. 1 having maintenance modules in resting positions.

FIG. 2 shows a side view of one embodiment of the system 300. In the embodiment shown, the track 308 is curved to guide the maintenance modules 316, 320 close to the first row of printheads 324 of the printhead array 304 and close to the second row of printheads 328. The curve is configured to provide an ideal angle of approach and exit for the wiper modules 316, so that debris is effectively wiped from the printheads without accidental flinging of the debris onto other components.

FIG. 2 shows the wiper modules 316 and the capping modules 320 in their respective resting positions 404. When the maintenance modules 316, 320 are at the resting positions 404, the printhead array 304 can operate normally, including performing printing operations. In one embodiment, when maintenance is performed, the printheads of the printhead array 304 first purge ink from inkjets of the printheads into a purge tray 408 positioned beneath the printhead array 304.

Figure 3:
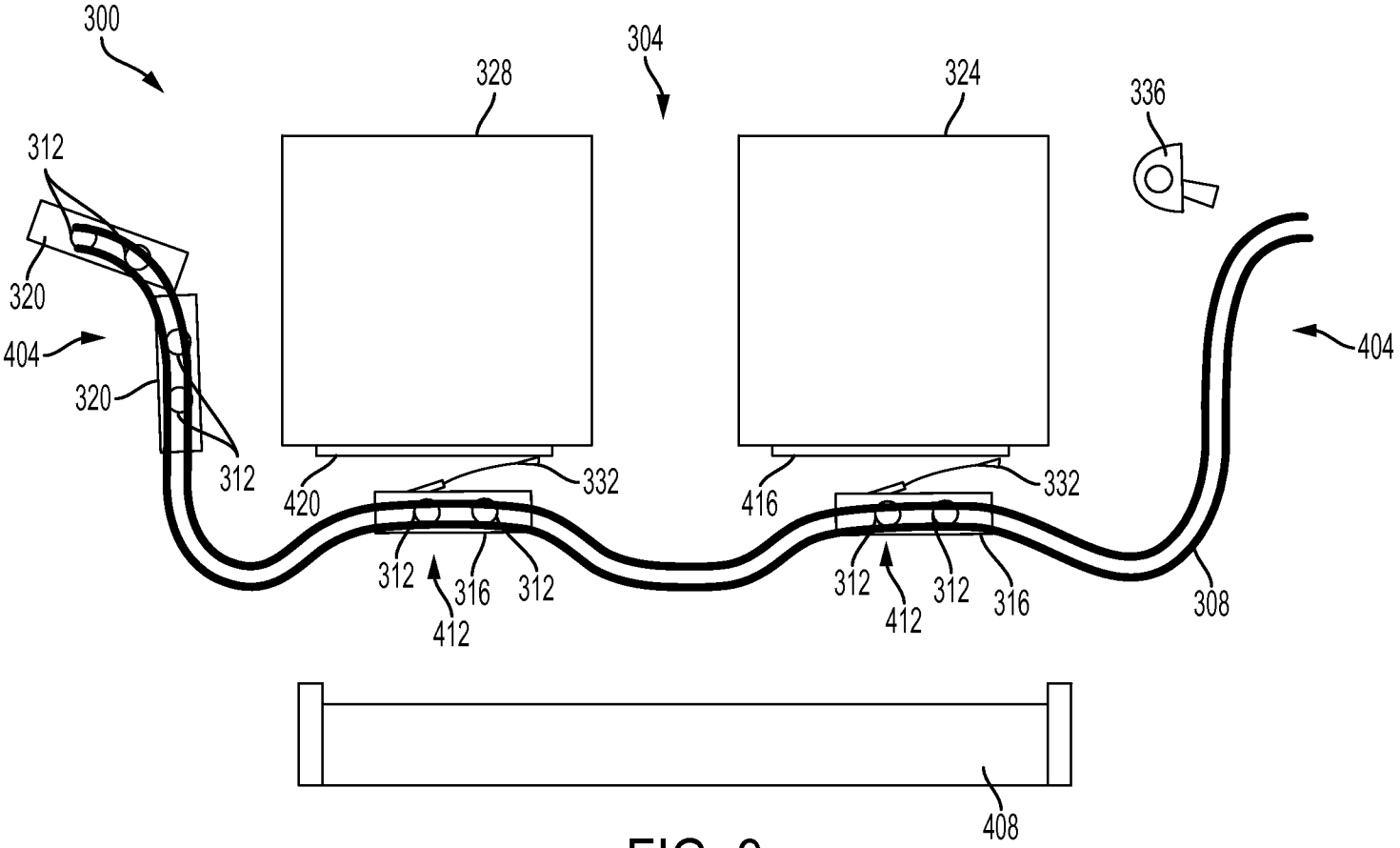
FIG. 3 shows a side view of the system of FIG. 1 having wiper modules in operating positions.

Next, as shown in FIG. 3, the wiper modules 316 move from their respective resting positions 404 to the operating positions 412 at which the wiper modules 316 are configured to wipe a surface 416 of the first row of printheads 324 and a surface 420 of the second row of printheads 328. In one embodiment, the wiper modules 316 have a wiper blade 332 configured to wipe against the surfaces 416, 420 of the rows of printheads 324, 328 as the wiper modules 316 move through the operating positions 412. As shown in FIG. 3, two shafts 312 having wiper modules 316 are included. In one embodiment, each shaft 312 is configured with wiper modules 316 to align with one or both of the rows of printheads 324, 328. However, in other embodiments, a single shaft 312 having wiper modules 316 is provided and configured to wipe both of the rows of printheads 324, 328, one after the other. In some embodiments, the printhead array 304 is configured to selectively move toward the track 308 to enable the wiper blades 332 of the wiper modules to make contact with the surfaces 416, 420 of the rows of printheads 324.

After the wiper modules 316 wipe the surfaces 416, 420 of the rows of printheads 324, 328, the wiper modules 316 return to their respective resting positions 404. In one embodiment, the printhead array 304 is configured to selectively move away from the track 308 to enable the wiper modules 316 to return to their respective resting position 404 without accidental contact with the printhead array 304. In some embodiments, the system 300 includes a wiper cleaning device 336 configured to clean the wiper modules 316 after a wiping operation. The wiper cleaning device 336 includes a brush, foam, or an equivalent structure configured to wipe against the wiper blades 332 of the wiper modules 316 as they move along the track 308 to pass the wiper cleaning device 336. In one embodiment, the wiper cleaning device 336 is positioned adjacent to the resting position 404 for the wiper modules 316 and is configured to wipe against the wiper blades 332 of the of the wiper modules 316 as they return to their resting positions 404.

Figure 4:
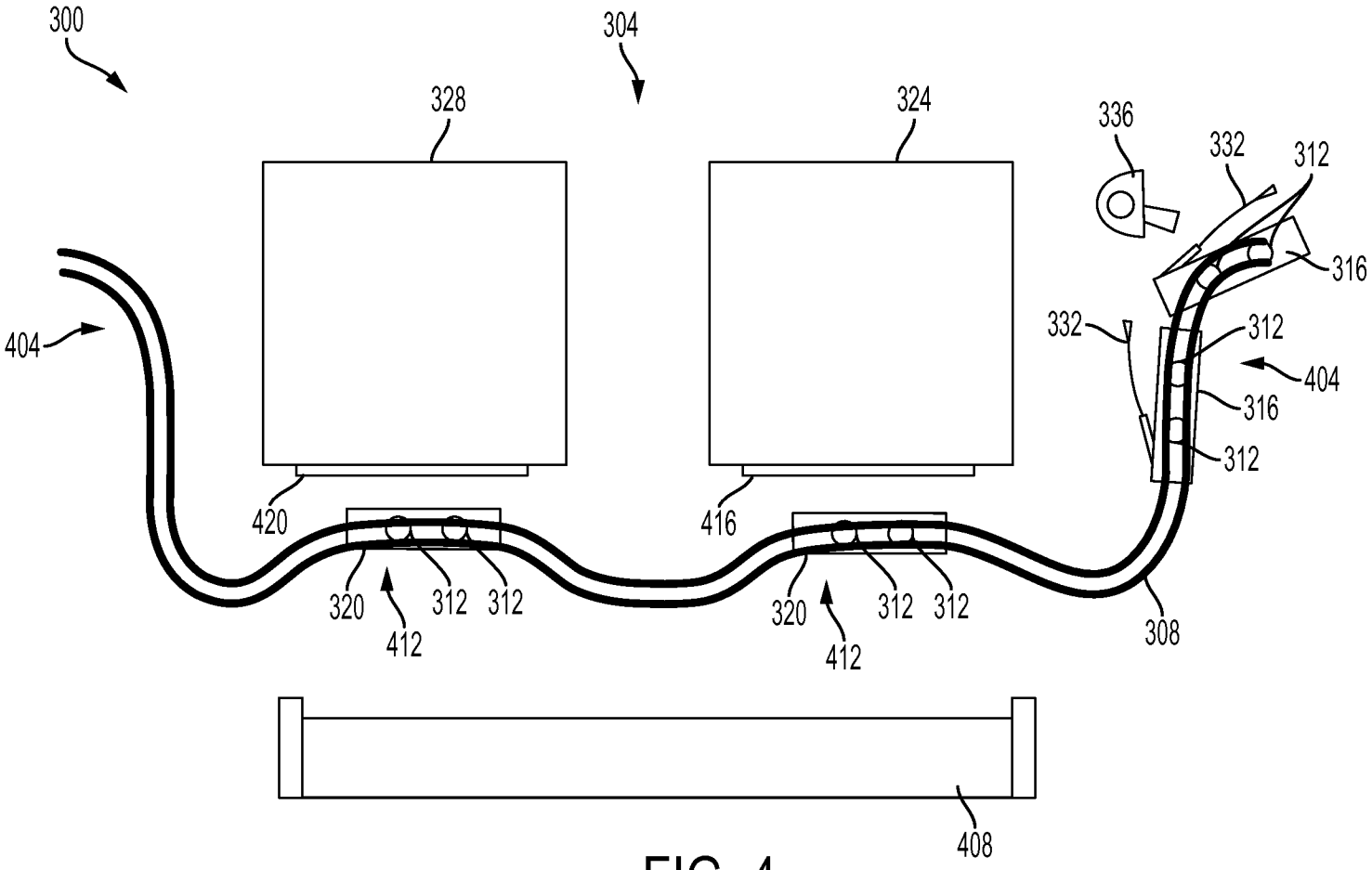
FIG. 4 shows a side view of the system of FIG. 1 having capping modules in operating positions.

Next, as shown in FIG. 4, the capping modules 320 move from their respective resting positions 404 to the operating positions 412 from which the capping modules 320 are configured to perform a capping operation on the rows of printheads 324, 328 when the printhead array 304 is lowered towards the capping modules 320 at positions 412. A capping operation refers to the covering of one or more printheads with a cap to seal the printhead face from ambient air to prevent the inkjets in the newly purged printheads from drying out before the next use of the printheads. In one embodiment, when the capping modules 320 are at the operating positions 412, the printhead array 304 moves toward the track 308 to bring the capping modules 320 into contact with the surfaces 416, 420 of the rows of printheads 324, 328 to perform the capping operation. When the covered printheads are required for printing, the printhead array 304 is raised and the capping modules 320 return to their respective resting positions 404.

Figures 5, 6:
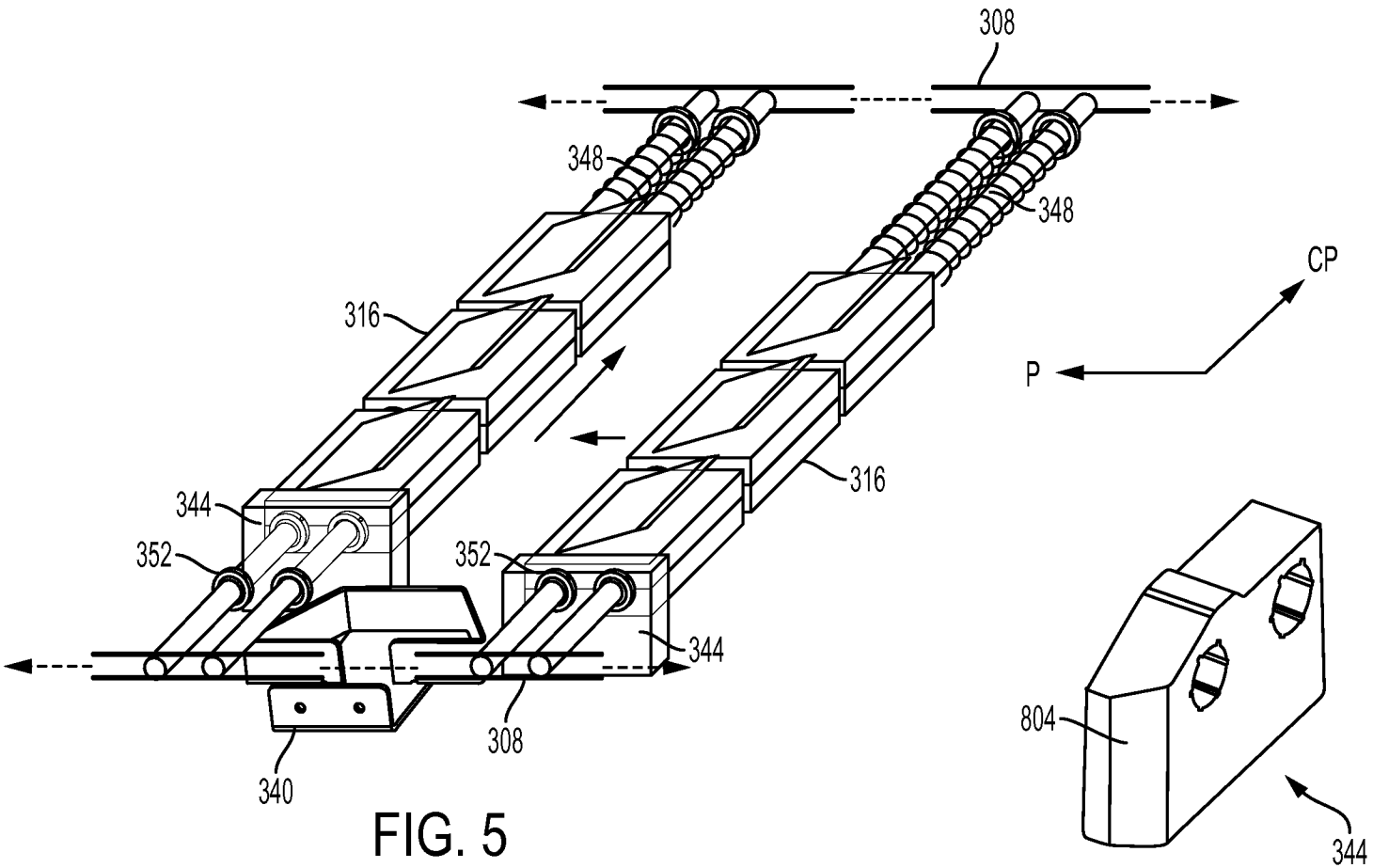
FIG. 5 shows shifting wiper modules with a bias block and bias bracket.
FIG. 6 shows one embodiment of a bias block.

As discussed above, in some embodiments, the second row of printheads 328 is misaligned with the first row of printheads 324 in the cross-process direction CP, such that the wiper modules 316 must shift in the cross-process direction CP to wipe the second row of printheads 328. In some embodiments, the system 300 includes a bias bracket 340 positioned between the tracks 308 along the path of the shafts 312, as shown in detail in FIG. 5. Bias blocks 344 are mounted on the shafts 312 and configured to slide along the shafts 312 to push the wiper modules 316 along the shaft in the cross-process direction CP. The bias bracket 340 is configured to engage with the bias blocks 344 as the shaft moves toward to operating position 412 corresponding to the second row of printheads 324. FIG. 6 shows one embodiment of the bias block 344 having a sloped surface 804 configured to engage with and slide along the bias bracket 340. When the bias bracket 340 engages with a bias block 344, the bias block 344 is moved along the shaft 312 in the cross-process direction CP and pushes against the wiper modules 316 to move them along the shaft 312 a first distance. In one embodiment, the first distance corresponds to the misalignment of the second row of printheads 328 with the first row of printheads 324 in the cross-process direction CP. In this way, the bias bracket 340 and bias block 344 are configured to move the wiper modules 316 into alignment with the printheads of the second row of printheads 328.

In one embodiment, springs 348 are configured along the shafts 312 to push against the wiper modules 316 in a direction that is opposite the direction that the bias block 344 is moved by the bias bracket 340. As the shafts 312 move past the bias bracket 340, the bias block 344 disengages with the bias bracket 340. After the bias block 344 disengages with the bias bracket 340, the springs 348 push the wiper modules 316 to return them to a position that is in alignment with the printheads of the first row of printheads 324. In the embodiment of FIG. 5, collars 352 are mounted on the shafts 312 to provide a stopping point corresponding to a position of the wiper modules 316 at which they are in alignment with the printheads of the first row of printheads 324.

Figure 7:
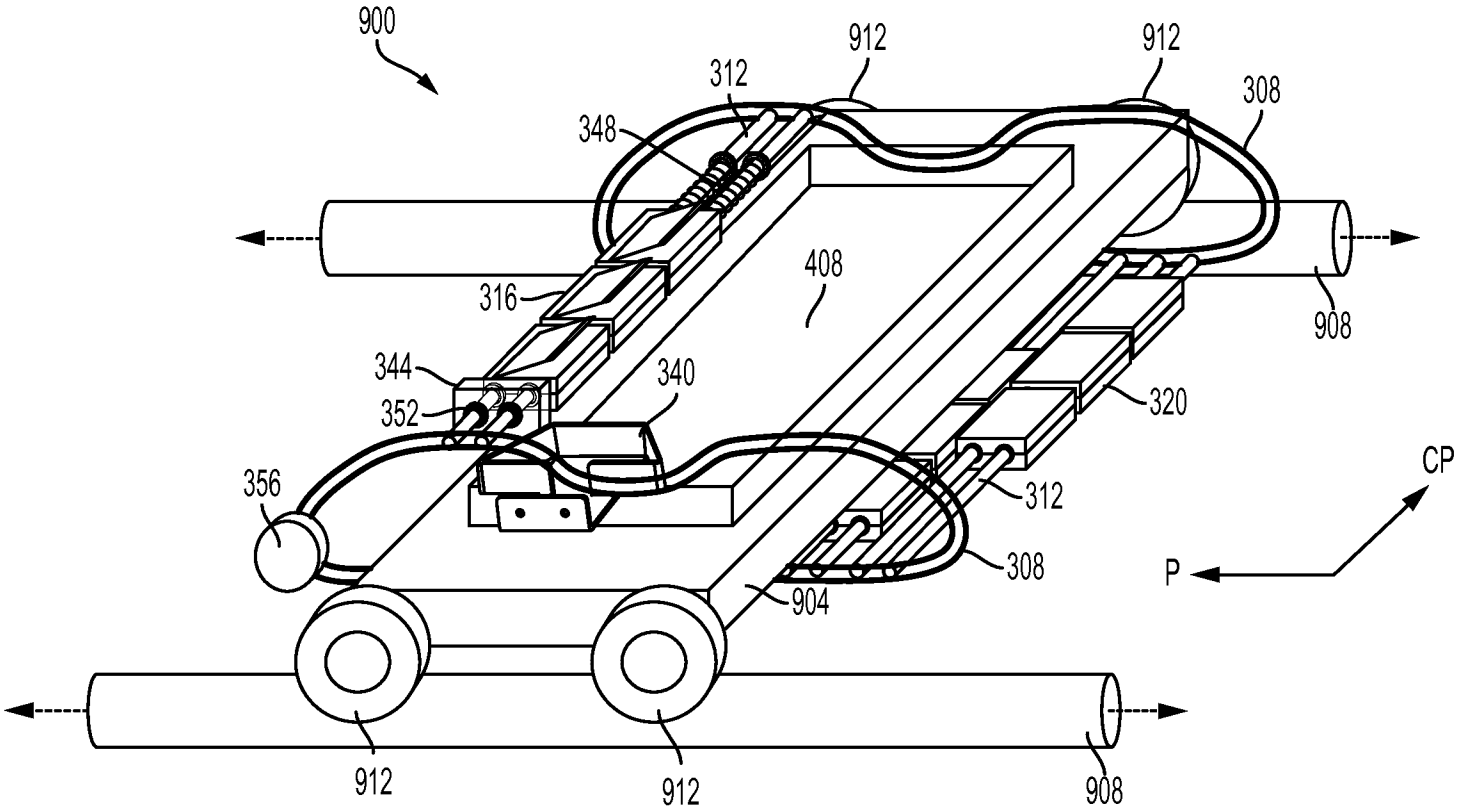
FIG. 7 shows a perspective view of a maintenance cart having a maintenance system for maintaining a scalable printhead array.

The maintenance modules 316, 320 are configured to be moved along the tracks 308 with a common drive mechanism. Although only depicted in FIG. 1 and FIG. 7, an actuator, such as an electric motor 356, can be provided in the various depicted embodiments to convey the shafts 312 having the maintenance modules 316, 320 along the tracks 308. As shown in FIG. 7, the actuator is operatively connected to a chain or other endless drive (not shown), which is operatively connected to the shafts 312. The actuator 356 can be operated to move the shafts 312 bi-directionally within the tracks 308.

FIG. 7 shows a maintenance cart 900 having a maintenance system for maintaining a scalable printhead array, which is similar to the maintenance system 300 of FIG. 1. Similar components are labeled with similar reference labels. The cart 900 has a cart body 904 configured to move along a path to a printhead array 304 (shown in FIG. 9). In one embodiment, the path is defined by a pair of rails 908. The cart 900 includes a set of wheels 912 configured to roll along the rails 908 to guide the cart body 904 to and from a printhead array 304. In one embodiment, the rails 908 are also used by a printing platform that conveys a substrate to the printhead array 304 for printing operations.

Figure 8:
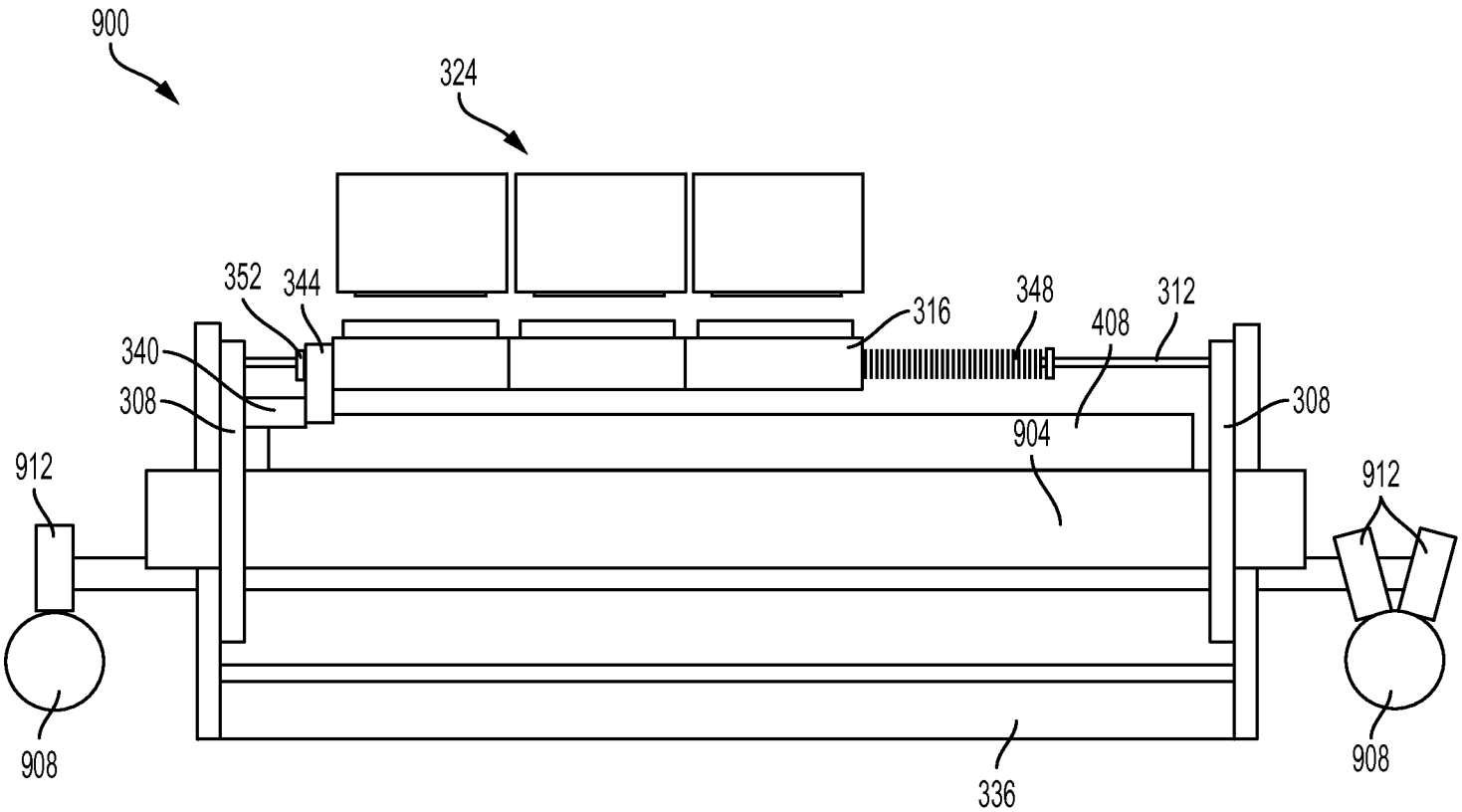
FIG. 8 shows a front view of the maintenance cart of FIG. 7.

The cart 900 includes a pair of tracks 308 mounted to the cart body 904. The tracks 308 run in parallel with one another on opposite sides of the cart. In one embodiment, as shown in FIG. 7, the tracks 308 run in the process direction P and around the cart body 904 to form a closed loop. The cart 900 includes shafts 312 having maintenance modules 316, 320 that are configured to move along the tracks 308 to perform maintenance operations on the printhead array 304. In some embodiments, a bias bracket 340, bias blocks 344, springs 348, and collars 352 are provided and operate as described with respect to the system 300. Additionally, a purge tray 408 is mounted to the cart body 904 and configured to receive purged ink from the printhead array 304 during maintenance operations. FIG. 8 shows a front view of the cart 900. As shown in FIG. 8, in some embodiments, the cart 900 may include a wiper cleaning device 336 mounted to an underside of the cart body 904.

Figure 9:
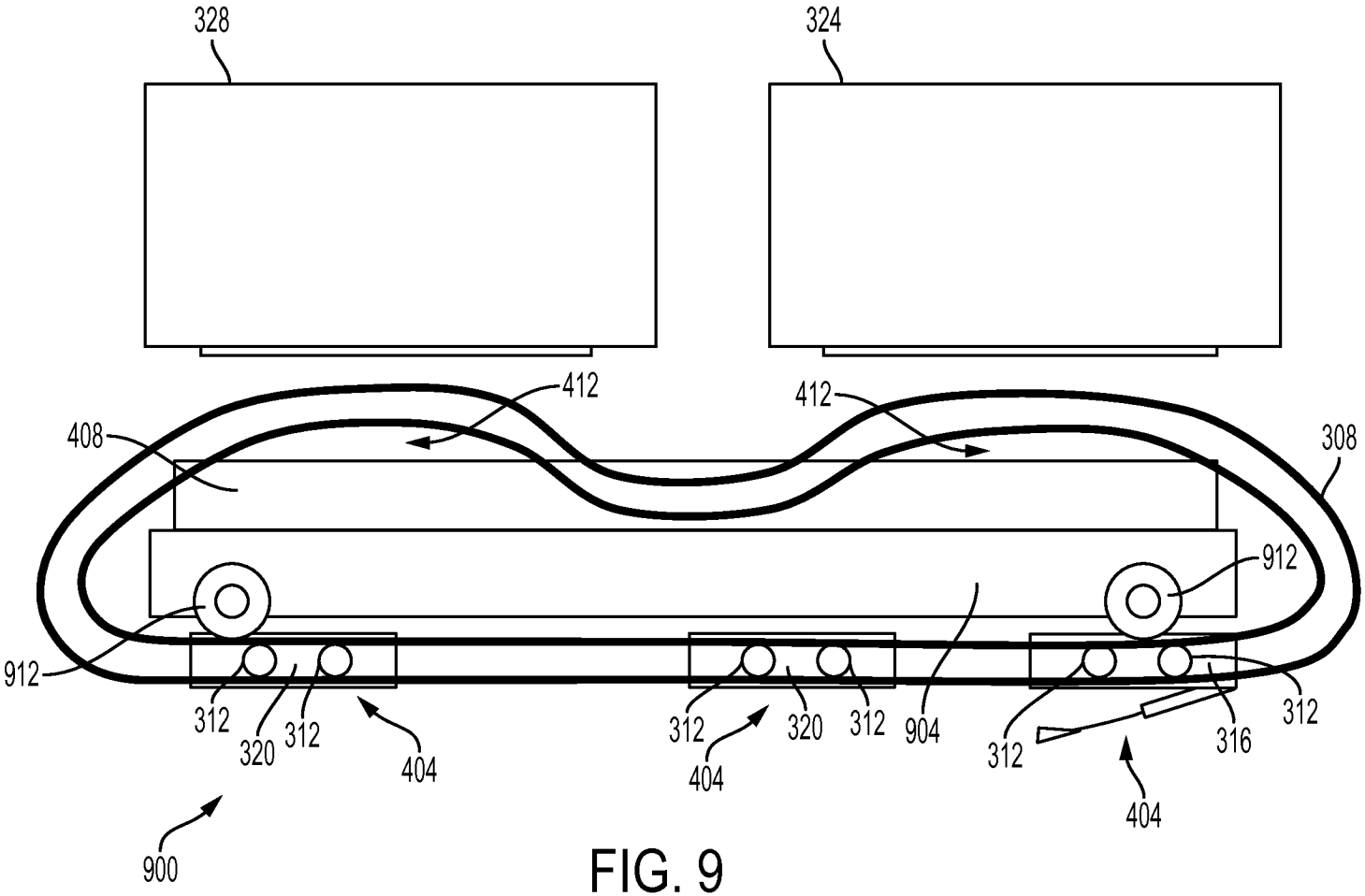
FIG. 9 shows a side view of the maintenance cart of FIG. 7 having maintenance modules in resting positions.

FIG. 9 shows a side view of the cart 900. As shown, the maintenance modules 316, 320 are positioned at resting positions 404 to enable the printhead array 304 to operate normally and to purge ink into the purge tray 408. To perform maintenance on the printhead array 304, the maintenance modules 316, 320 move to the operating positions 412 from which the maintenance modules 316, 320 are configured to perform maintenance operations on the printhead array 304. In FIG. 9, the rails 908 are not depicted to simplify the presentation.

Figure 10:
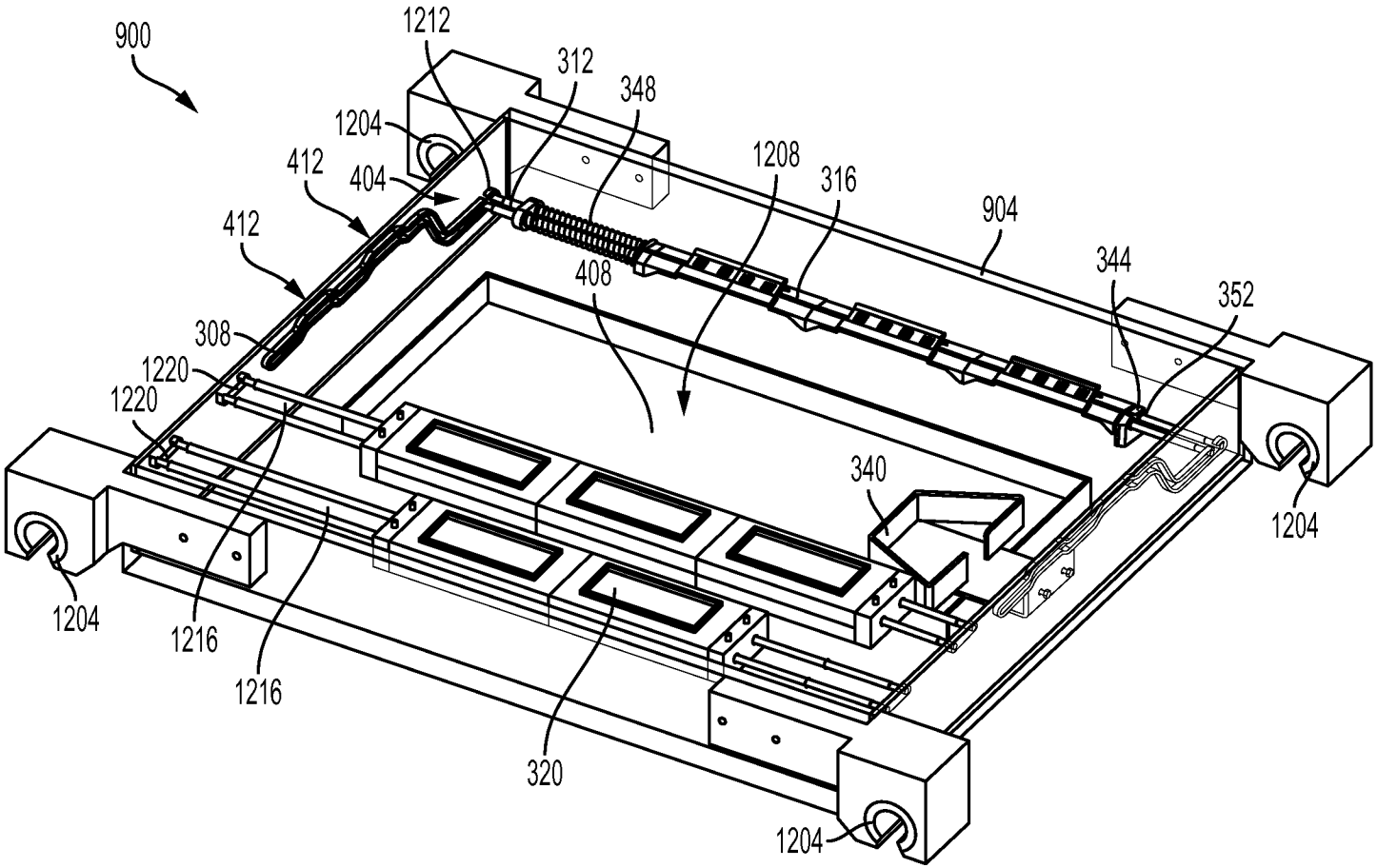
FIG. 10 shows a perspective view of a different embodiment of a maintenance cart for maintaining a scalable printhead array.

FIG. 10 shows a different embodiment of the maintenance cart 900. In the embodiment shown, the cart 900 includes guides 1204 configured to mount onto the rails 908 (not shown) to move along the rails 908 to and from the printhead array 304 (not shown). A cart body 904 has a continuous perimeter that forms a recess 1208 within the perimeter. Tracks 308 are mounted on opposite sides of the recess 1208 and configured to guide a shaft 312 having wiper modules 316 from a resting position 404 to operating positions 412 to enable the wiper modules 316 to wipe debris from printheads of the printhead array 304. In some embodiments, the tracks 308 include at least one cut-out 1212 configured to allow the shafts 312 to be removed from the tracks 308. In some embodiments, a bias bracket 340, bias blocks 344, springs 348, and collars 352 are provided and operate as described with respect to the system 300. Additionally, a purge tray is mounted within the recess 1208 of the cart body 904 and configured to receive purged ink from the printhead array 304 during maintenance operations. In one embodiment, capping modules 320 are mounted on stationary shafts 1216. The shafts 1216 extend across the recess 1208 and are mounted within the recess 1208 with mounts 1220. The mounts 1220 are configured to allow the shafts 1216 to be removed. The cart 900 is configured to move along the rails 908 to align the capping modules 320 with printheads of the printhead array 304 to enable the capping modules 320 to perform capping operations on the printheads of the printhead array 304.

Figure 11:
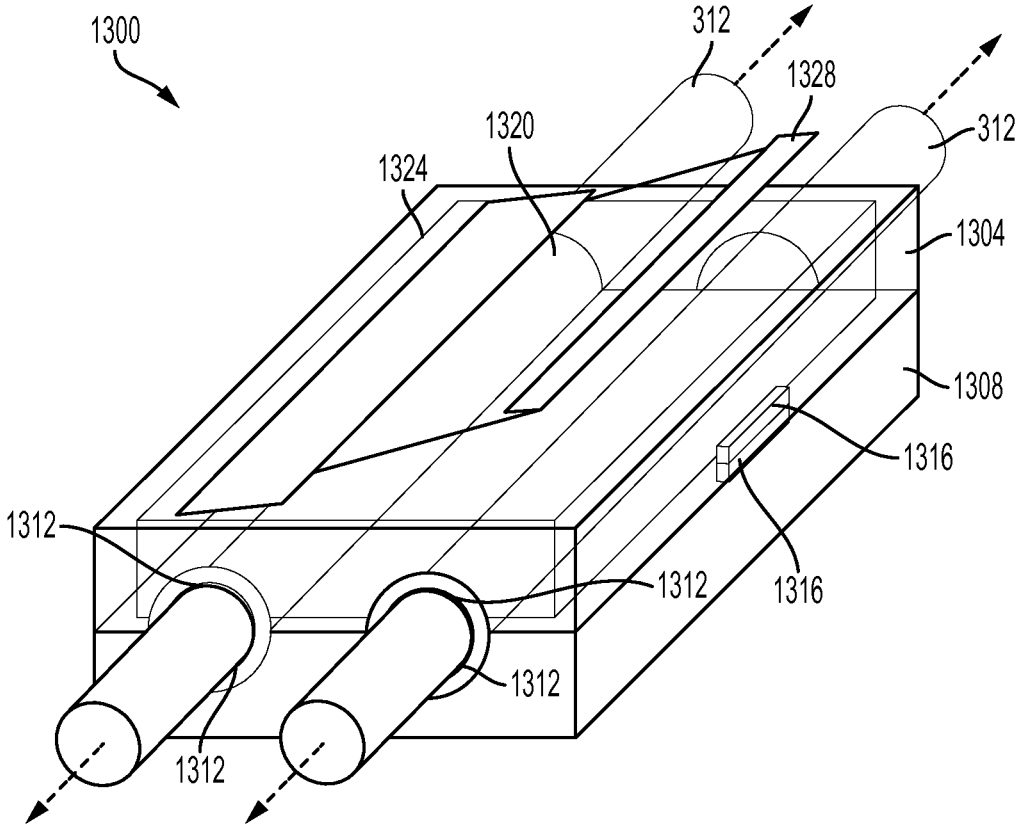
FIG. 11 shows a perspective view of one embodiment of a wiper module.
Figure 12:
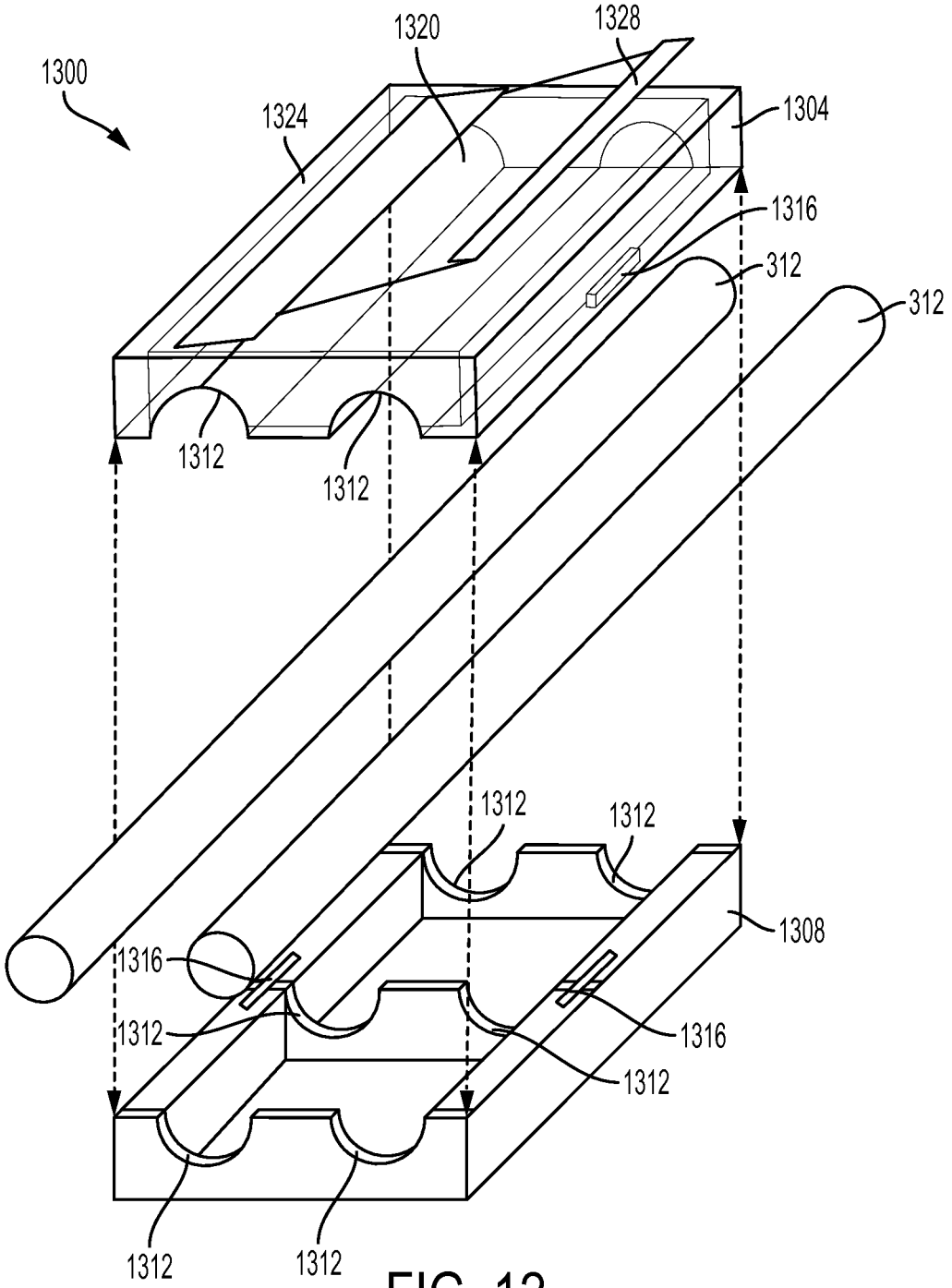
FIG. 12 shows an exploded view of the wiper module of FIG. 11.

FIG. 11 shows a wiper module 1300, which is one embodiment of the wiper modules 316. The wiper module 1300 has a lid 1304 and a base 1308. The lid 1304 and the base 1308 are configured to join together around the shafts 312. FIG. 12 shows an exploded view of the wiper module 1300, demonstrating how the lid 1304 and the base 1308 join together around the shafts 312. The shafts 312 fit into cut-outs 1312 in the lid 1304 and base 1308. The cut-outs 1312 are configured to allow the wiper module 1300 to slide freely along the shafts 312. Magnets 1316 are provided in the lid 1304 and the base 1308 and configured to removably connect the lid 1304 to the base 1308. In this way, the wiper module 1300 is configured to be easily mounted to or removed from the shafts 312, without detaching the shafts 312 from the tracks 308.

A wiper blade 1320 is mounted to a surface 1324 of the lid 1304, which is opposite a surface of the lid 1304 that joins with the base 1308. In one embodiment, the wiper blade 1320 is made of a rigid material, such as metal, and includes a wiper tip 1328 made of a soft material, such as rubber. The wiper tip 1328 is configured to make contact with and wipe against a surface of a printhead of the printhead array 304. In one embodiment, the wiper blade 1320 is mounted to the surface 1324 of the lid 1304 at an acute angle. In one embodiment, the wiper blade 1320 has a width that is about equal to a width of the wiper module 1300. In one embodiment, the width of the wiper blade 1320 corresponds to a width of surface of a printhead of the printhead array 304.

Figure 13:
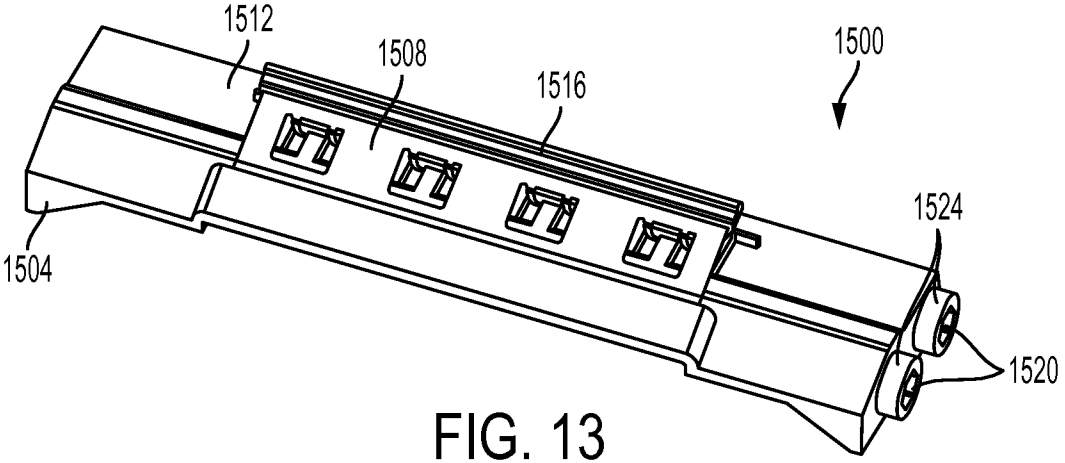
FIG. 13 shows a perspective view of a different embodiment of a wiper module.

FIG. 13 shows a wiper module 1500, which is another embodiment of the wiper modules 316. The wiper module 1500 has a body 1504 that is configured to mount onto shafts 312 (shown in FIG. 15). A wiper blade 1508 is mounted on a surface 1512 of the body 1504. In one embodiment, the wiper blade 1508 is made of a rigid material, such as metal, and includes a wiper tip 1516 made of a soft material, such as rubber. The wiper tip 1516 is configured to make contact with and wipe against a surface of a printhead of the printhead array 304. In one embodiment, the wiper blade 1508 is mounted to the surface 1512 at an acute angle. In one embodiment, the width of the wiper blade 1508 corresponds to a width of surface of a printhead of the printhead array 304. In one embodiment, the wiper module 1500 has a width that corresponds to a width of a printhead assembly that holds a printhead of the printhead array 304.

Figure 14:
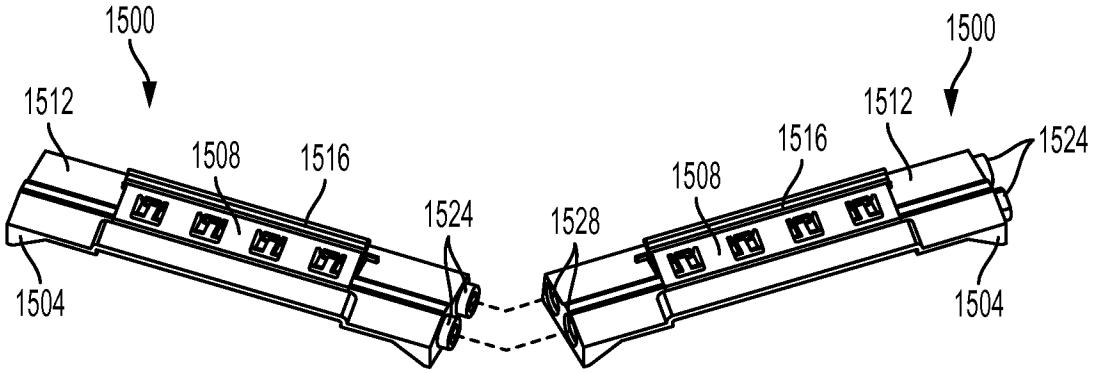
FIG. 14 shows interlocking a pair of the wiper modules of FIG. 13.
Figure 15:
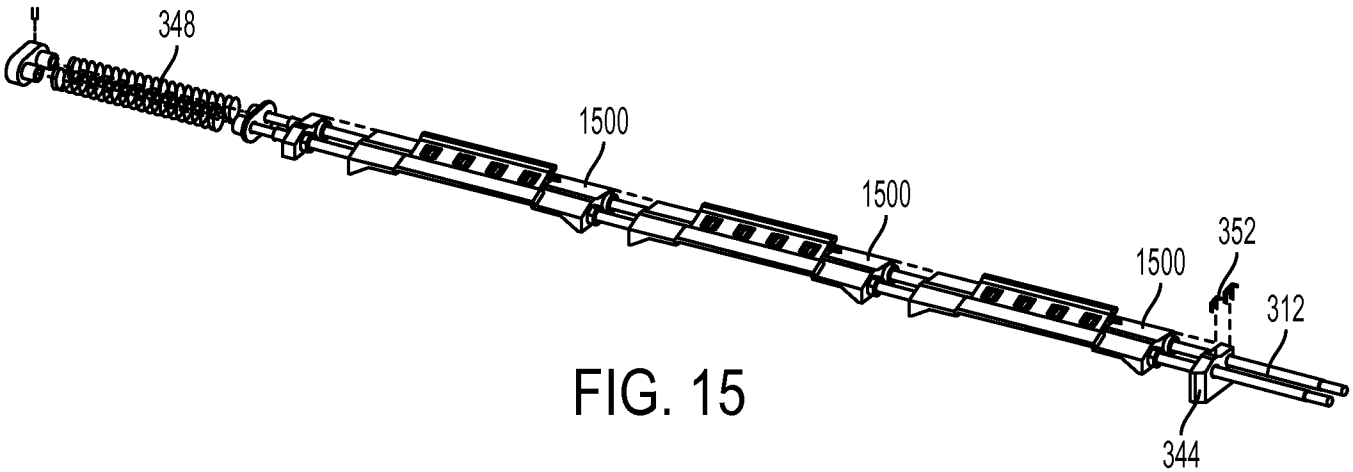
FIG. 15 shows an exploded view of the wiper modules of FIG. 13 arranged on a shaft.
Figure 16:
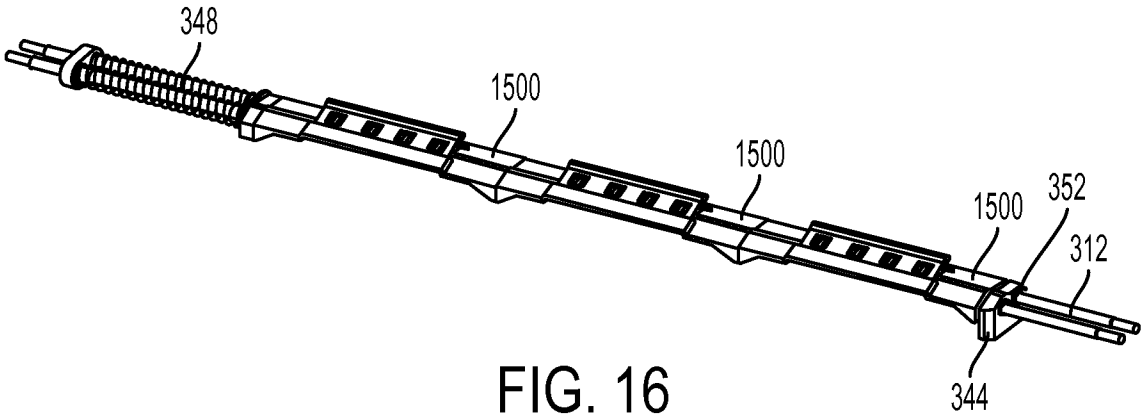
FIG. 16 shows the wiper modules of FIG. 13 interlocked with one another on a shaft.

The wiper module 1500 includes holes 1520 that extend through the body 1504 from first end to an opposite second end and are configured to receive the shafts 312. At the first end of the body 1504, the holes 1520 have collar portions 1524. At the second end of the body 1504, the holes 1520 have counter-bored portions 1528, as shown in FIG. 14. The collar portions 1524 are configured to interlock with the counter-bored portions 1528 of another wiper module 1500. FIG. 15 shows an exploded view of several wiper modules 1500 arranged on shafts 312. In one embodiment, a bias block 344, springs 348, and collars 352 are also arranged on the shafts 312 as described with respect to the system 300. FIG. 16 shows the wiper modules 1500 arranged on the shafts 312 and interlocked with one another.

Figure 17:
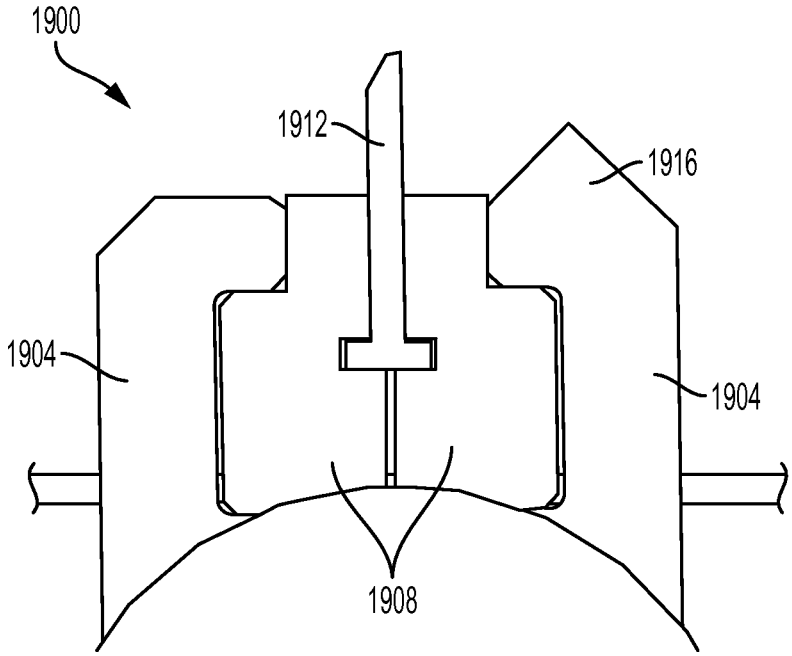
FIG. 17 shows a wiper blade with a protrusion for breaking large debris.
Figure 18:
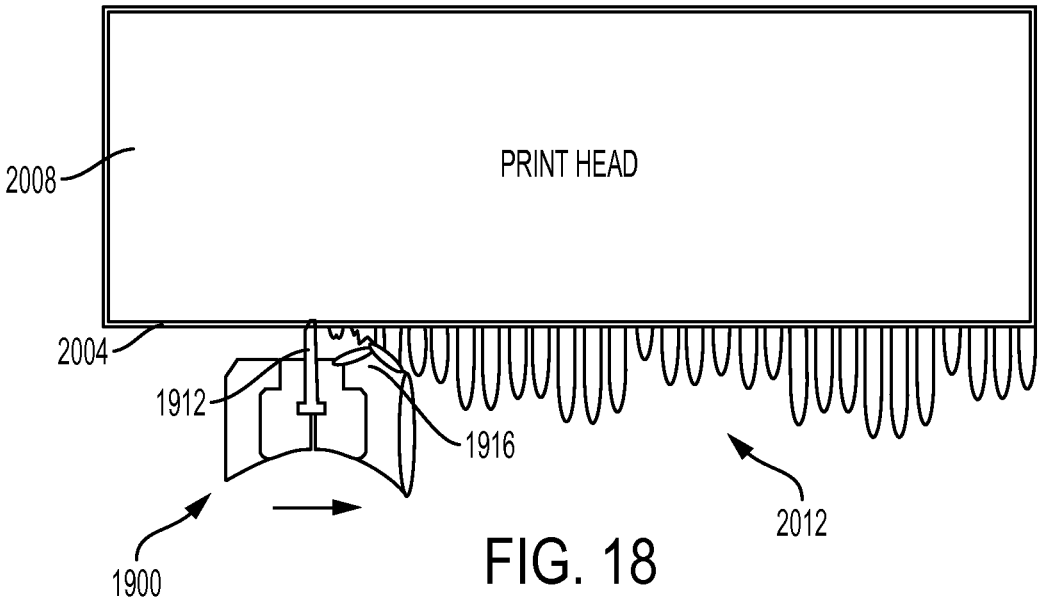
FIG. 18 shows the wiper blade of FIG. 17 wiping a surface of a printhead.

FIG. 17 shows a wiper blade 1900, which, in some embodiments, is used in conjunction with one of the wiper module embodiments discussed above. The wiper blade 1900 is mounted atop a body of a wiper module 316 (not shown). The wiper blade 1900 includes a holder 1904. The holder 1904 is configured to receive a pair of plates 1908 and a wiper portion 1912. The wiper portion 1912 is configured to interlock between the pair of plates 1908, and to extend out from the pair of plates 1908 in a first direction. The interlocked wiper portion 1912 and the pair of plates 1908 are configured to slide laterally into an interlocked position with the holder 1904. The holder 1904 has a protrusion 1916 that protrudes in the first direction near the wiper portion 1912. The wiper portion 1912 extends in the first direction further than the protrusion 1916 extends in the first direction. In one embodiment, the protrusion 1916 is made of a rigid material, such as metal, and the wiper portion 1912 is made of a soft material, such as rubber. As shown in FIG. 18, as the wiper blade 1900 wipes against a surface 2004 of a printhead 2008, the protrusion 1916 breaks away large debris 2012 from the surface 2004 before the wiper portion 1912 wipes against the surface 2004. The protrusion 1916 does not come into contact with the surface 2004, but only breaks away the large debris 2012 to allow the wiper portion 1912 to wipe the surface 2004 more effectively.

Figure 19:
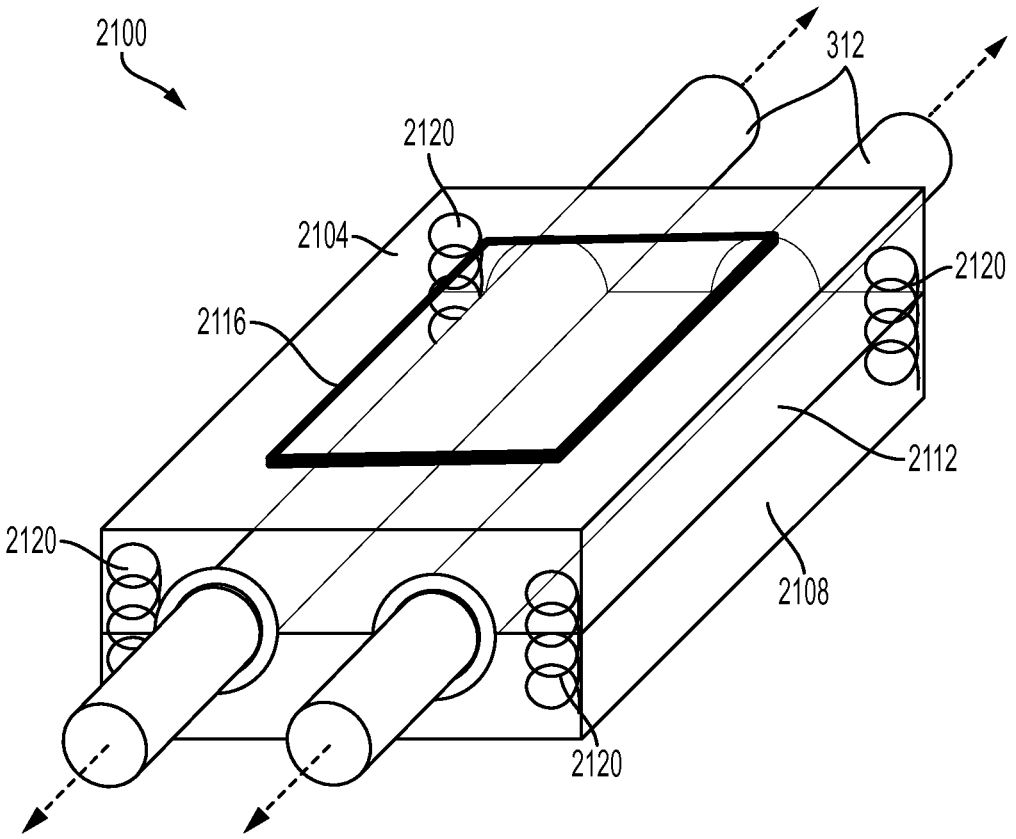
FIG. 19 shows one embodiment of a capping module.

FIG. 19 shows a capping module 2100, which is one embodiment of the capping modules 320. The capping module 2100 has a body 2104 that is configured to slide onto shafts 312. In one embodiment, the body 2104 has a base 2108 and a lid 2112 that are configured to join together around the shafts 312. The capping module 2100 includes a capping surface 2116. In one embodiment, the capping surface is molded plastic. In the depicted embodiment, the body 2104 has a width corresponding to a width of a printhead assembly and the capping surface 2116 has a width corresponding to surface of a printhead of the printhead assembly. When the capping module 2100 is aligned with a printhead, the capping surface 2116 presses against a surface of the printhead to perform a capping operation on the printhead. In one embodiment, the capping module 2100 has springs 2120 configured to bias the capping surface 2116 towards the surface of the printhead.

It will be appreciated that variants of the above-disclosed and other features and functions, or alternatives thereof, may be desirably combined into many other different systems, applications or methods. Various presently unforeseen or unanticipated alternatives, modifications, variations, or improvements therein may be subsequently made by those skilled in the art, which are also intended to be encompassed by the following claims.

What is claimed is:

1. A maintenance system for a printhead array comprising:

a pair of tracks disposed in parallel and on opposite sides of the printhead array;

a shaft extending between the pair of tracks and configured to engage with each track of the pair of tracks and to move along the pair of tracks;

a plurality of maintenance modules mounted in series along the shaft between the pair of tracks and configured to move along the pair of tracks with the shaft to perform maintenance operations on a plurality of printheads of the printhead array, the pair of tracks being configured to guide the shaft and the plurality of maintenance modules along a path from a resting position to an operating position the printhead array and from which at least one of the plurality of maintenance modules performs a maintenance operation on at least one printhead of the printhead array; and an actuator configured to move the shaft along the pair of tracks.

2. The system of claim 1, the pair of tracks being further configured to:

guide the shaft and the plurality of maintenance modules along a path from the resting position to (i) a first operating position from which at least one of the plurality of maintenance modules performs the maintenance operation on a first printhead of the printhead array and to (ii) a second operating position from which the at least one of the plurality of maintenance modules performs the maintenance operation on a second printhead of the printhead array.

3. The system of claim 2 further comprising:

a member mounted along the shaft between the pair of tracks and configured to move along the shaft in a first direction and push the plurality of maintenance modules along the shaft in the first direction; and a bracket positioned between the pair of tracks along the path of the shaft to engage the member as the shaft moves along the pair of tracks, the bracket being configured to move the member a first distance in the first direction along the shaft when the bracket engages the bias block, the first distance corresponding to a displacement in the first direction of the first printhead of the printhead array and the second printhead of the printhead array.

4. The system of claim 3 further comprising:

a spring mounted along the shaft between the pair of tracks and configured to push against at least one of the member and the plurality of maintenance modules in a second direction that is opposite of the first direction.

5. The system of claim 1, wherein:

the pair of tracks is mounted to a frame of a printer; and the printhead array is moved independently of the pair of tracks.

6. The system of claim 1 further comprising:

a purge tray positioned with reference to the printhead array to receive purged material from printheads of the printed array.

7. The system of claim 1, the at least one of the plurality of maintenance modules further comprising:

a wiper module configured to move along the pair of tracks with the shaft to perform a wiping operation on a surface of the at least one printhead of the printhead array to remove material from the surface.

8. The system of claim 7, the wiper module further comprising:

a body portion configured to attach to the shaft; and a wiper blade extending from the body portion and configured to wipe against the surface of the at least one printhead of the printhead array when the wiper module is in the operating position to remove material from the surface of the at least one printhead.

9. The system of claim 8, the wiper module further comprising:

a protrusion extending from the body portion and configured to break away material hanging from the surface of the at least one printhead of the printhead array before the wiper blade wipes against the surface of the at least one printhead.

10. The system of claim 1, at least one of the plurality of maintenance modules further comprising:

a capping module configured to move along the pair of tracks with the shaft to perform a capping operation on the at least one printhead of the printhead array.

11. The cart of claim 1, the at least one of the plurality of maintenance modules further comprising:

a capping module configured to move along the pair of tracks with the shaft to perform a capping operation on the at least one printhead of the printhead array.

12. A maintenance cart for a printhead array comprising:

a body configured to move selectively along a path to the printhead array;

a pair of tracks being mounted in parallel on the body and configured to position the pair of tracks on opposite sides of the printhead array in response to the body moving to the printhead array;

a shaft extending between the pair of tracks and configured to engage with each track of the pair of tracks and to move along the pair of tracks;

a plurality of maintenance modules mounted in series along the shaft between the pair of tracks, the plurality of maintenance modules being configured to move along the pair of tracks with the shaft to perform maintenance operations on a plurality of printheads of the printhead array in response to the body being positioned at the printhead array, the pair of tracks being configured to guide the shaft and the plurality of maintenance modules along a path from a resting position to an operating position from which at least one of the plurality of maintenance modules performs a maintenance operation on at least one printhead of the printhead array; and an actuator configured to move the shaft along the pair of tracks.

13. The cart of claim 12, the pair of tracks being further configured to:

guide the shaft and the plurality of maintenance modules along a path from the resting position to (i) a first operating position from which at least one of the plurality of maintenance modules performs the maintenance operation on a first printhead of the printhead array and to (ii) a second operating position from which the at least one of the plurality of maintenance modules performs the maintenance operation on a second printhead of the printhead array.

14. The cart of claim 13 further comprising:

a member mounted along the shaft between the pair of tracks, the member being configured to push the plurality of maintenance modules along the shaft in a first direction in response to the member moving along the shaft in the first direction; and a bracket positioned between the pair of tracks along the path of the shaft to engage with the member as the shaft moves along the pair of tracks, the bracket being configured to move the member a first distance in the first direction along the shaft when the bracket engages the member, the first distance corresponding to a displacement in the first direction of the first printhead of the printhead array and the second printhead of the printhead array.

15. The cart of claim 14 further comprising:

a spring mounted along the shaft between the pair of tracks and configured to push against at least one of the member and the plurality of maintenance modules in a second direction that is opposite to the first direction.

16. The cart of claim 12, wherein the pair of tracks are mounted to an outer surface of the body and configured as a closed loop around the body.

17. The cart of claim 12, wherein:

the body includes a recess; and the pair of tracks are mounted within the recess.

18. The cart of claim 12, the at least one of the plurality of maintenance modules further comprising:

a wiper module configured to move along the pair of tracks with the shaft to perform a wiping operation on a surface of the at least one printhead of the printhead array to remove material from the surface.

19. The cart of claim 18, the wiper module further comprising:

a body portion configured to attach to the shaft; and a wiper blade extending from the body portion and configured to wipe against the surface of the at least one printhead of the printhead array when the wiper module is in the operating position to remove material from the surface.

20. The cart of claim 19, the wiper module further comprising:

a protrusion extending from the body portion and configured to break away material hanging from the surface of the at least one printhead of the printhead array before the wiper blade wipes against the surface.

* * * * *